United States Patent [19]

Anhalt et al.

[11] 4,431,244

[45] Feb. 14, 1984

[54] ELECTRICAL CONNECTOR WITH INTEGRAL LATCH

[76] Inventors: John W. Anhalt, 2128 White Lantern, Orange, Calif. 92667; John Gardner, 17755 San Candelo St., Fountain Valley, Calif. 92708

[21] Appl. No.: 177,005

[22] Filed: Aug. 11, 1980

[51] Int. Cl.[3] ..... H01R 13/631

[52] U.S. Cl. ..... 339/91 R

[58] Field of Search ..... 339/91 R, 91 P, 75 P

[56] References Cited

U.S. PATENT DOCUMENTS

| | | | |
|---|---|---|---|
| 3,569,909 | 3/1971 | Garver | 339/91 R |
| 3,605,070 | 9/1971 | Krafthefer | 339/91 R |
| 3,688,243 | 8/1972 | Yamada et al. | 339/91 R |
| 3,753,212 | 8/1973 | Yamada et al. | 339/91 R |
| 4,010,998 | 3/1977 | Tolnar, Jr. et al. | 339/91 R |
| 4,168,877 | 9/1979 | Little et al. | 339/91 R |

*Primary Examiner*—John McQuade

[57] ABSTRACT

An electrical connector assembly in which a latching lever is formed in the wall of the receptacle connector of the assembly. The lever has a latch shoulder engageable with a catch on the mating plug connector. The lever is pivotally mounted on the receptacle connector housing by integral live hinge pivots which extend laterally from the sides of the lever so that the lever is pivotable about an axis passing laterally through the receptacle housing, thereby providing a very low profile connector.

10 Claims, 6 Drawing Figures

FIG. 1
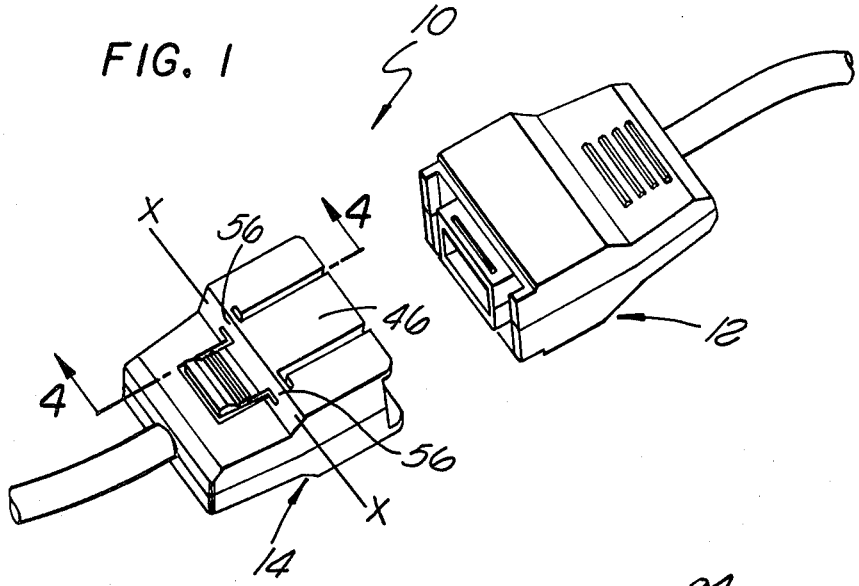
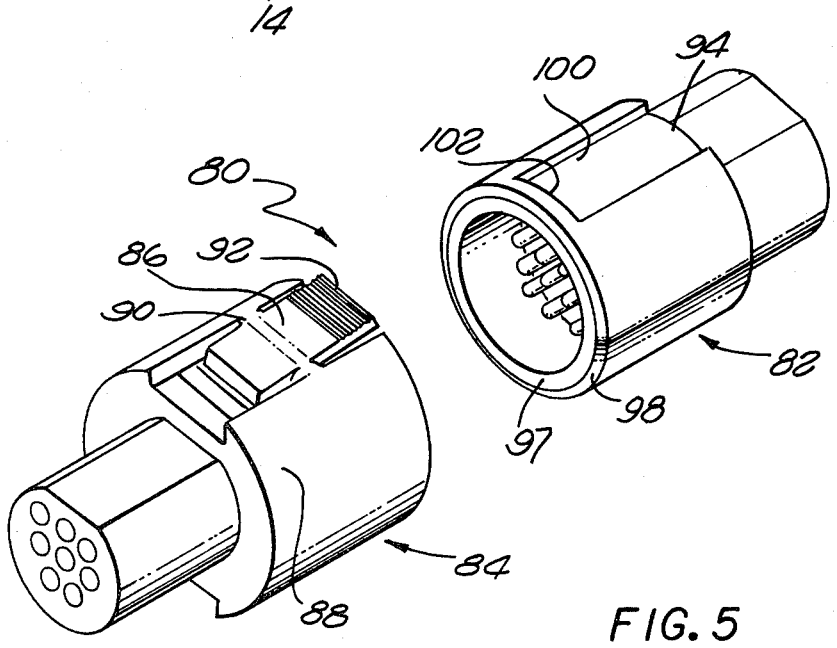
FIG. 5

ELECTRICAL CONNECTOR WITH INTEGRAL LATCH

BACKGROUND OF THE INVENTION

The present invention relates generally to an electrical connector assembly and, more particularly, to an improved latching arrangement for an electrical connector assembly.

It is common practice in the electrical connector art to provide on all plastic connectors, integral latching arrangements which will allow positive locking together of the mating connector halves thereby insuring that electrical continuity is maintained under varying conditions of vibration and separating forces which would otherwise result in the loss of electrical continuity. Typically, the latching arrangement includes an integral, molded-in lever which is pivotable about a leg that extends laterally outwardly from the housing of one of the connector halves, and embodies a latch shoulder which is engageable with a catch on the mating connector half when the two halves are interengaged. Examples of such latching arrangements for electrical connectors are disclosed in the following U.S. Pat. Nos. 3,399,374; 3,409,858; 3,569,909; 3,588,784; 3,926,497 and 4,192,568. While such latching arrangements are generally satisfactory, they have the disadvantage that because they extend outwardly from the housing of the connector, the connector has a relatively high profile which may be objectionable if space is at a premium in the environment in which the connector is intended to be utilized.

U.S. Pat. No. 3,133,777 discloses a plastic electrical conductor in which a flexible, oval shaped outer ring on one connector half embodies a latching recess which cooperates with a lug on the mating connector half when the two halves are interengaged. While this latching arrangement allows the connector to have a low profile, the oval sleeve disposed around the periphery of the the connector is subject to damage during handling of the connector. U.S. Pat. No. 3,605,070 discloses a connector having two outwardly extending latching arms on opposite sides of one connector half, and an apertured tongue on a third side of the mating connector half engageable with a lug on the first half. While the tongue is formed by a pair of slots in the wall of the second connector half, and, thus, has a relatively low profile, manipulation of the connector to effect disassembly thereof is relatively complicated since three fingers are required in order to release the latch arms and tongue.

It is the object of the present invention to provide an improved latching arrangement for an electrical connector which has a very low profile, is simple in construction and inexpensive to manufacture, is positive in function and may be released by simply squeezing the opposite sides of one connector half while pulling the connector halves apart to disengage the same.

SUMMARY OF THE INVENTION

According to a principal aspect of the present invention, there is provided an electrical connector assembly comprising mating plug and receptacle connectors each having a housing of insulating material. A longitudinally extending lever is formed in the wall of the receptacle connector housing. Live hinge pivot means extend laterally from the longitudinally extending sides of the lever so that the lever is pivotable about an axis passing laterally through the receptacle connector housing. A latching shoulder is provided on the lever on the front of the pivot means which engages a catch on the plug connector housing when the plug and receptacle connectors are mated.

Because the lever is formed in the wall of the receptacle connector housing, the connector has a very low profile. Normally a pair of such levers are formed in the receptacle connector housing on opposite sides thereof so that simply by squeezing the ends of the levers and pulling the connector halves away from each other, the latching shoulders on the levers will be released from the catches on the plug connector housing and the connectors will be readily disengaged in a single manual operation.

Other aspects and advantages of the invention will become more apparent from the following description taken in connection with the accompanying drawings.

BRIEF DESCRIPTION OF THE DRAWINGS

FIG. 1 is a perspective view of the mating plug and receptacle connectors of the electrical connector assembly of the present invention, shown in unmated condition;

FIG. 5 is a perspective view similar to FIG. 1 showing a modified form of the connector assembly of the present invention.

DESCRIPTION OF THE PREFERRED EMBODIMENTS

Figure 2:
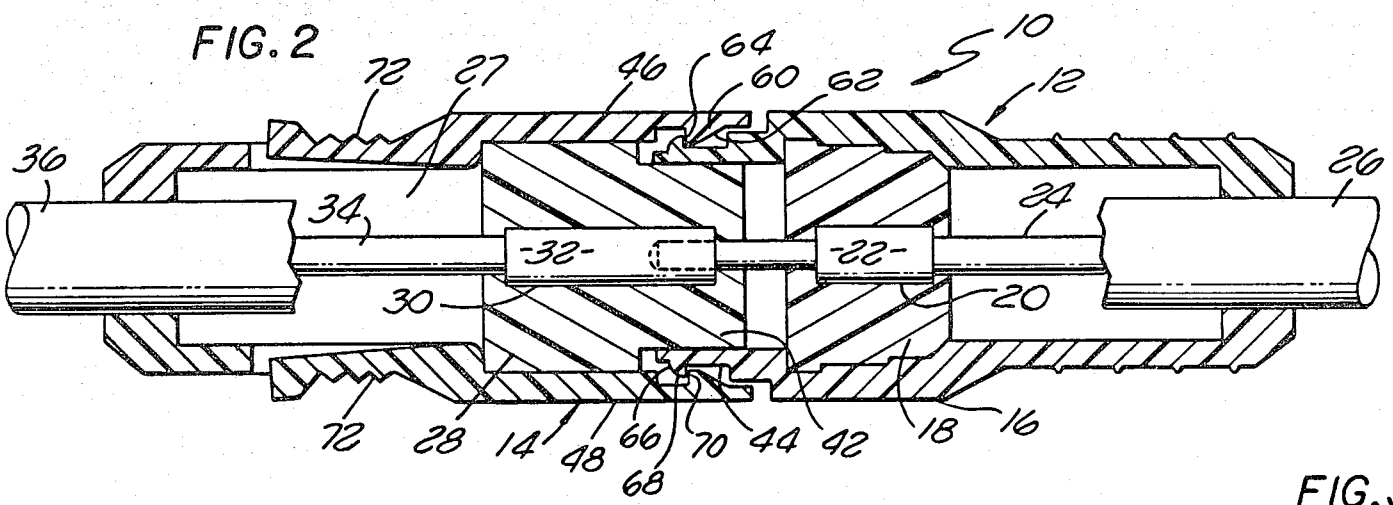
FIG. 2 is a longitudinal sectional view through the connector assembly illustrated in FIG. 1 with the connector halves fully mated.

Referring now to FIGS. 1 and 2 of the drawings in detail, there is illustrated one embodiment of the connector assembly of the present invention, generally designated 10. The connector assembly comprises a plug connector 12 and a receptacle connector 14. As seen in FIG. 2, the plug connector member 12 comprises a molded plastic housing 16 containing an insulator insert 18 having a plurality of contact passages 20 therein, only one being shown for the purpose of simplicity. A pin contact 22 is mounted in the passage 20. The contact is connected to the wire 24 of a cable 26 which extends outwardly through the rear of the housing 16.

The receptacle connector 14 also comprises a housing 27 containing an insulator insert 28 embodying contact passages 30 corresponding in number to the passages 20. A socket contact 32 connected to the wire 34 of cable 36 is mounted in the passage 30, and is mateable with the pin contact 22 when the plug and receptacle connectors are interengaged, as seen in FIG. 2.

Figure 4:
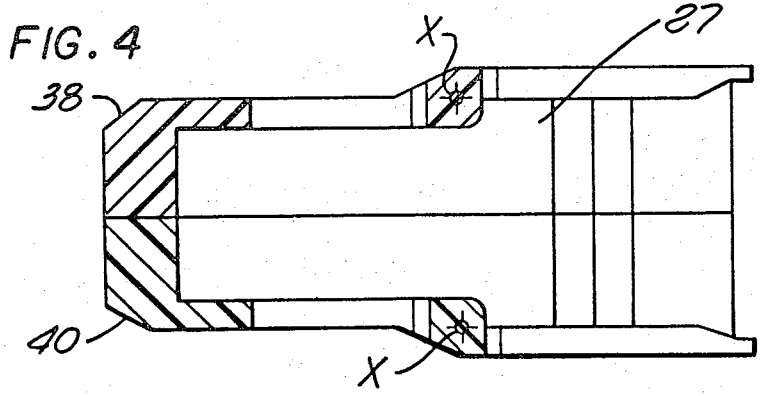
FIG. 4 is a longitudinal sectional view taken along line 4—4 of FIG. 1 showing the housing of the receptacle connector.

Preferably, the housings of the plug and receptacle connectors are formed of two parts. For example, as seen in FIG. 4, the housing 27 of the receptacle connector is longitudinally divided into an upper part 38 and lower part 40. The two parts are preferably formed by injection molding techniques, and may be secured together after mounting the insulator insert 28 therein by means of screws, not shown, passing vertically through the sides of the housing.

Figure 3:
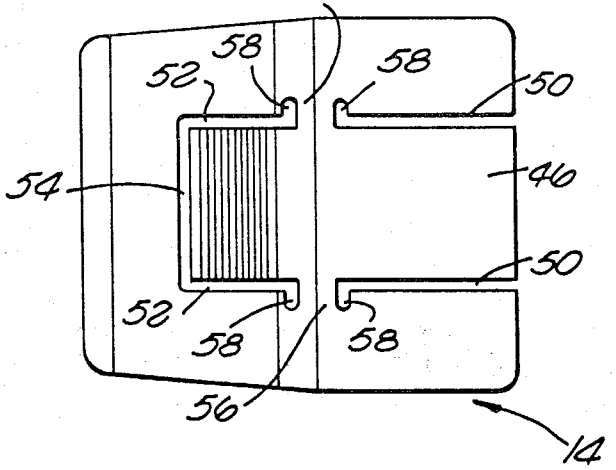
FIG. 3 is a top plan view of the receptacle connector illustrated in FIGS. 1 and 2.

As best seen in FIG. 1, the plug and receptacle connectors of the assembly 10 have basically a rectangular configuration. The forward end 42 of the insert 28 of the receptacle connector has a rectangular cross-section less than that of the forward end of housing 27 thereby defining a rectangular channel therebetween which receives the forward end 44 of the housing of the plug connector 12 when the connectors are interengaged, as seen in FIG. 2. As best seen in FIGS. 1 and 3, a latching lever 46 is formed in the upper wall of housing 27. An identical lever 48 is formed in the lower wall opposite to the first lever. Since the levers are identical, only lever 46 will be described in detail. The latching lever 46 is formed by a first pair of longitudinally extending parallel slots 50 in the upper wall of the housing 27, a second pair of longitudinally extending slots 52 aligned with and spaced behind the first pair of slots 50, and a laterally extending slot 54 which joins the rear ends of the slots 52. The spaced pairs of slots 50 and 52 define therebetween live hinge pivot arms 56 which extend laterally from the longitudinally extending sides of the lever 46 and are joined to the outer regions of the upper wall of the housing. Preferably short slots 58 extend laterally outward from the adjacent ends of the slots 50 and 52 thereby increasing the length of the pivot arms so that the lever 46 will be capable of greater deflection.

A laterally extending rib 60 is formed on the inside of the lever 46 adjacent to its forward end. The rib is shaped to provide an angular ramp 62 at its forward end and a latching shoulder 64 at its rear end which extends in a plane perpendicular to the longitudinal axis of the receptacle connector. A similar laterally extending rib 66 is formed on the outside of the forward portion 44 of plug housing 16. Rib 66 embodies a forwardly facing angular ramp 68 and a catch shoulder 70. When the plug and the receptacle connectors are initially mated, the ramps 62 and 68 on the ribs 60 and 66, respectively will cooperate to cause the forward ends of the levers 46 and 48 to expand until the ribs 66 pass under the ribs 60 whereby the latter will snap inwardly due to the resilience of the plastic lever so that the latching shoulders 64 will face the latching shoulder 70 thereby positively locking the connector halves together. When the aforementioned ribs pass each other during the mating operation of the connectors, an audible snap occurs which indicates that the connectors are fully mated. To separate the connectors, pressure is applied by the thumb and forefinger to the serrated rear ends 72 of the levers 46 and 48 causing the levers to pivot as a result of the live hinge pivot arms 56 undergoing torsion, thereby raising the forward ends of the levers to release the latching shoulders 64 from the catch shoulders 70 on the plug connector housing. In this position, the connectors are unlocked and may be unmated by pulling apart.

It will be appreciated that because the live hinge pivot arms 56 extend laterally from the sides of the levers, the levers will pivot around laterally extending axes, for example the axis X—X for lever 46 in FIG. 1, which pass through the wall of the receptacle connector housing so that the profile of the housing is not increased by the provision of the latching lever in the present invention. As a consequence, a very low profile connector is achieved. In addition, the latching levers are simply formed by the provision of a series of slots in the housing wall of the receptacle connector which may be easily and inexpensively formed during the injection molding of the upper and lower halves of the housing. Furthermore, a simple one step operation of squeezing the rear ends of the levers and pulling the connectors apart is all that is necessary to unlock and disengage the mating halves of the connector assembly.

Figure 6:
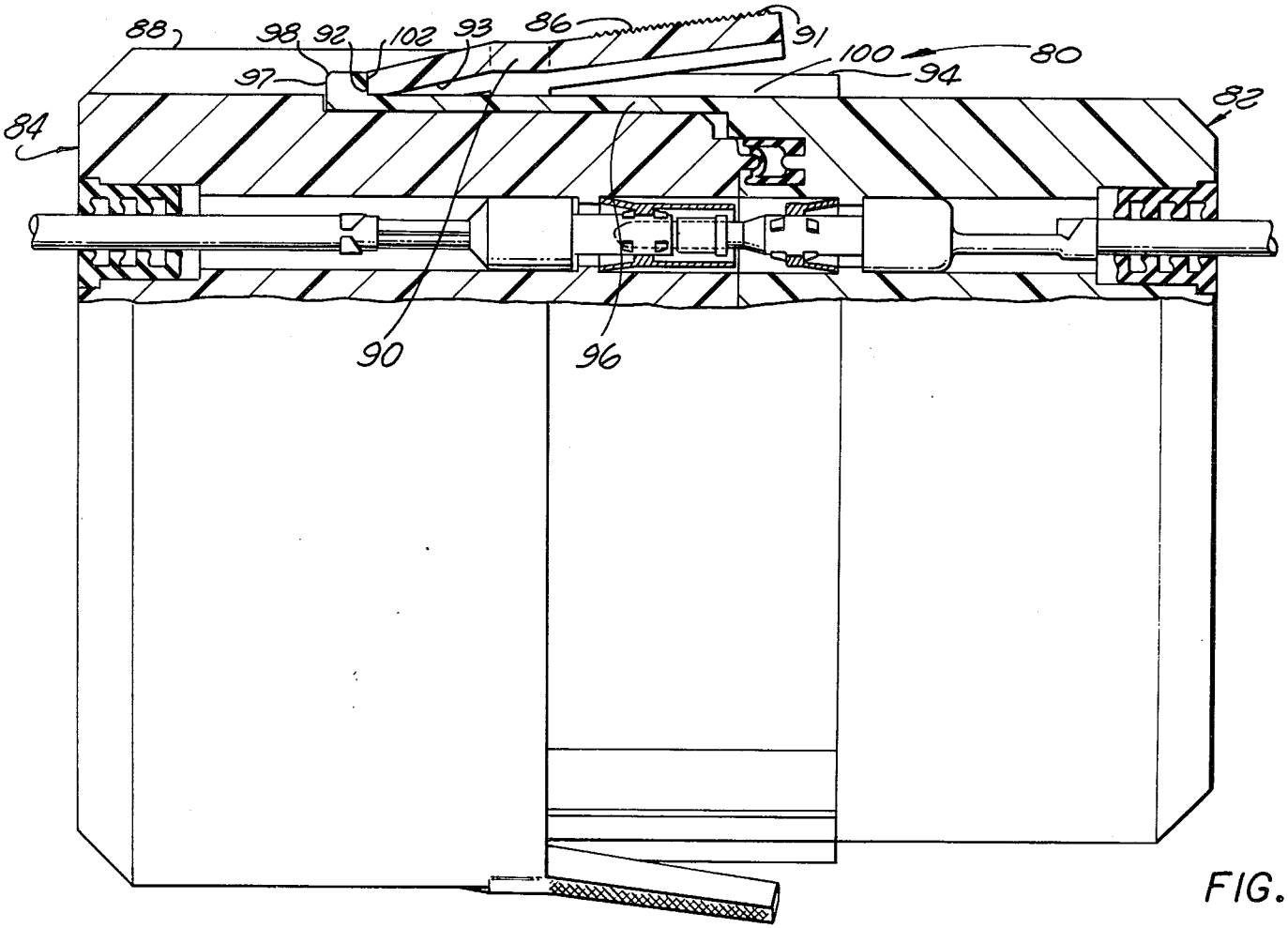
FIG. 6 is a partial longitudinal sectional view of the connector assembly shown in FIG. 5 with the connector halves fully mated.

Reference is now made to FIGS. 5 and 6 of the drawings which illustrates a modified form of the connector assembly of the present invention, generally designated 80, in which the plug connector 82 and receptacle connector 84 have a cylindrical, rather than rectangular, configuration. As in the previous embodiment, the latching lever 86 is formed by a series of slots in the housing 88 of the receptacle connector 84. Thus, the pivot arms 90 extend laterally from the sides of the lever. The lever is inclined outwardly in the forward direction. The outer surface of the forward portion 91 of the lever is serrated,. The latching shoulder on the lever 86 is formed by the rear surface 92 of the lever. An angular ramp 93 is formed on the inside of the lever between the pivot 90 and latching shoulder 92.

The plug connector 82 comprises a cylindrical body 94 embodying a forwardly extending hood 96 the forward end 97 of which is beveled as indicated at 98. A longitudinally extending groove 100 in the outer surface of the body 94 is spaced from the forward end 97 of the hood to provide a rearwardly facing catch shoulder 102. As the plug and receptacle connectors are initially mated, the ramp 93 and bevel 98 cooperate to deflect the rear portion of the lever 86 outwardly whereby it may pass over the forward end of the hood. When the lever fully enters the groove 100, the rear portion thereof will snap inwardly positioning the latching shoulder 92 behind the catch 102 so that the two connector halves are positively locked together. The plug and receptacle connectors are unlocked and unmated by pressing the serrated forward portion 91 of the lever 86 inwardly and pulling the connectors apart.

What is claimed is:

1. An electrical connector assembly comprising:

mating plug and receptacle connectors each having a housing of insulating material;

a longitudinally extending lever formed in the wall of said receptacle connector housing;

live hinge pivot means extending laterally from the longitudinally extending sides of said lever whereby said lever is pivotable about an axis passing laterally through said receptacle connector housing;

a latching shoulder on said lever on one side of said pivot means;

catch means on said plug connector housing engageable by said latching shoulder when said plug and receptacle connectors are mated;

said lever being formed by a plurality of slots in said wall of said receptacle connector housing, said slots defining the periphery of said lever and said pivot means;

said plurality of slots including a first pair of longitudinally extending parallel slots opening at the forward end of said receptacle connector housing and a second pair of longitudinally extending parallel slots aligned with and spaced behind said first pair defining therebetween said pivot means; and an additional slot parallel to said axis and joined to the rear ends of said slots of said second pair.

2. An electrical connector assembly as set forth in claim 1 including:

laterally outwardly extending slots at the adjacent ends of said slots of said first and second pairs of slots further defining said pivot means.

3. An electrical connector assembly as set forth in claim 1 wherein:

a pair of said levers are formed in the wall of said receptacle connector housing on opposite sides thereof.

4. An electrical connector assembly as set forth in claim 1 wherein:

said latching shoulder is on the inside of said lever in front of said pivot means; and said catch means is provided by an outwardly extending protrusion on the wall of said plug connector housing.

5. An electrical connector assembly as set forth in claim 4 wherein:

the rear portion of said lever extends behind said pivot means a distance sufficiently great so that inward pressure applied against said rear portion will cause said latching shoulder to disengage from said protrusion.

6. An electrical connector assembly comprising:

mating plug and receptacle connectors each having a housing of insulating material;

a longitudinally extending lever formed in the wall of said receptacle connector housing;

live hinge pivot means extending laterally from the longitudinally extending sides of said lever whereby said lever is pivotable about an axis passing laterally through said receptacle connector housing;

a latching shoulder on said lever on one side of said pivot means;

catch means on said plug connector housing engageable by said latching shoulder when said plug and receptacle connectors are mated; and said latching shoulder being provided by the rear surface of said lever.

7. An electrical connector assembly as set forth in claim 6 wherein:

said catch means is formed by a groove in the outer surface of said plug connector housing behind the forward end thereof.

8. An electrical connector member comprising:

a housing of insulating material;

a longitudinally extending lever formed in the wall of said housing;

live hinge pivot means extending laterally from the longitudinally extending sides of said lever whereby said lever is pivotable about an axis passing through said housing;

a latching shoulder on said lever on one side of said pivot means;

said lever being formed by a plurality of slots in said wall of said housing, said slots defining the periphery of said lever and said pivot means;

said plurality of slots including a first pair of longitudinally extending parallel slots opening at the forward end of said housing and a second pair of longitudinally extending parallel slots aligned with and spaced behind said first pair defining therebetween said pivot means; and an additional slot parallel to said axis and joined to the rear ends of said slots of said second pair.

9. An electrical connector member as set forth in claim 8 including:

laterally outwardly extending slots at the adjacent ends of said slots of said first and second pairs of slots further defining said pivot means.

10. An electrical connector member as set forth in claim 8 wherein:

a pair of said levers are formed in the wall of said housing on opposite sides thereof.

* * * * *